US006910825B2

(12) United States Patent
Böckmann

(10) Patent No.: US 6,910,825 B2
(45) Date of Patent: Jun. 28, 2005

(54) CAP FOR A WRITING DRAWING OR PAINTING INSTRUMENT

(75) Inventor: Jürgen Böckmann, Tangstedt (DE)

(73) Assignee: Sanford GmbH, Hamburg (DE)

( * ) Notice: Subject to any disclaimer, the term of this patent is extended or adjusted under 35 U.S.C. 154(b) by 0 days.

(21) Appl. No.: 10/489,690

(22) PCT Filed: Jul. 4, 2002

(86) PCT No.: PCT/DE02/02445

§ 371 (c)(1),
(2), (4) Date: Sep. 16, 2004

(87) PCT Pub. No.: WO03/026903

PCT Pub. Date: Apr. 3, 2003

(65) Prior Publication Data

US 2005/0031406 A1 Feb. 10, 2005

(30) Foreign Application Priority Data

Sep. 14, 2001 (DE) ..... 101 45 051

(51) Int. Cl.[7] ..... A48B 17/04
(52) U.S. Cl. ..... 401/269; 401/202
(58) Field of Search ..... 401/243–247, 401/124, 202, 262, 269

(56) References Cited

U.S. PATENT DOCUMENTS 1,583,579 A 5/1926 Witt
1,838,543 A * 12/1931 Goldstein ..... 401/243
2,396,866 A * 3/1946 Lytton ..... 401/243
5,876,140 A * 3/1999 Kuramoto et al. ..... 401/243

FOREIGN PATENT DOCUMENTS

| | | |
|---|---|---|
| DE | 911589 | 5/1954 |
| DE | 1 802 121 | 7/1960 |
| FR | 2421738 | 11/1979 |

OTHER PUBLICATIONS

PCT International Search Report issued in PCT/DE02/02445, mailed Dec. 2, 2002.

PCT International Preliminary Examination Report issued in PCT/DE02/02445, mailed Jul. 7, 2003.

* cited by examiner

*Primary Examiner*—Justine R. Yu
*Assistant Examiner*—Huyen Le
(74) *Attorney, Agent, or Firm*—Marshall, Gerstein & Borun LLP

(57) ABSTRACT

A cap for a writing, drawing or painting implement, with a cap sheath and a clamping ring, characterised by the fact that the clamping ring is disposed separately in the cap sheath, and the inner peripheral surface the cap sheath and the outer and inner peripheral surfaces of the clamping ring are designed such that, by placing the cap on the housing of a writing, drawing or painting implement and then executing a relative axial twist between the cap and the housing, a firm axial fit between the cap and the housing results.

9 Claims, 4 Drawing Sheets

CAP FOR A WRITING DRAWING OR PAINTING INSTRUMENT

This patent is the U.S. National Phase of International Application No. PCT/DE02/02445, which was filed on Jul. 4, 2002.

The present invention relates to a cap for a writing, drawing or painting implement with a cap sheath and a clamping ring.

Many writing implements with removable caps, especially fountain pens, possess a screw-on cap which, while ensuring a secure connection between the housing of the writing implement and the cap, is nevertheless inconvenient and therefore cannot be used quickly.

DE-U 1 802 121 discloses a cap with a clamping ring disposed on the housing of the writing implement that provides a snap connection. There is, however, a risk that the snap connection might give way and that the housing might slip out of the cap or that the cap might slip out of the housing.

The invention is therefore based on the problem of improving the generic cap in such a way that a secure connection is provided between the housing of a writing, drawing or painting implement and the cap, while at the same time ensuring ease of operation.

In accordance with the invention, this problem is solved by having the clamping ring disposed separately in the cap sheath and designing the inner peripheral surface of the cap sheath and the outer and inner peripheral surfaces of the clamping ring such that, by placing the cap on the housing of a writing, drawing or painting implement and then executing a relative axial twist between the cap and the housing, a firm axial fit between the cap and the housing results.

In particular, it can be provided for the inner peripheral surface of the clamping ring to be designed such that, by placing the cap on the housing, a friction fit or positive fit results between the clamping ring and the housing.

In addition, it can be provided for the inner peripheral surface of the cap sheath and the outer peripheral surface of the clamping ring to be designed such that, by placing the cap on the housing of the writing, drawing or painting implement and then executing a relative axial twist between the cap and the housing, a friction fit results between the cap sheath and the clamping ring.

A particular embodiment of the invention is characterised by the fact that at least one wedge-shaped surface rising radially in the circumferential direction is disposed on the outer peripheral surface of the clamping ring and that a corresponding number of matching wedge-shaped surfaces are disposed on the inner peripheral surface of the cap sheath.

It is advantageous for the slopes of the wedge-shaped surfaces facing each other after the clamping ring has been inserted into the cap sheath to be identical.

Finally, it can be provided for the cap to be designed such that it can be placed on the housing and creates a seal in the process.

The invention is based on the surprising finding that the use of a clamping ring which develops its function by twisting the cap makes it possible to create a secure connection in a simple manner. The cap can be placed on in the usual manner and locked in place with a simple twist (<120°). The use of a separate clamping ring means that it is not necessary to search radially for the correct position, as is the case with a bayonet catch.

Furthermore, during the production of the cap, no spindle removal is needed, which would be necessary with a thread for a screw connection.

Further features and advantages of the invention will become apparent from the claims and the following description, in which one working embodiment is explained in detail with reference to the schematic drawings. There, FIG. 1 shows a longitudinal section view of a cap sheath of a cap in accordance with a particular embodiment of the invention;

Figure 1:
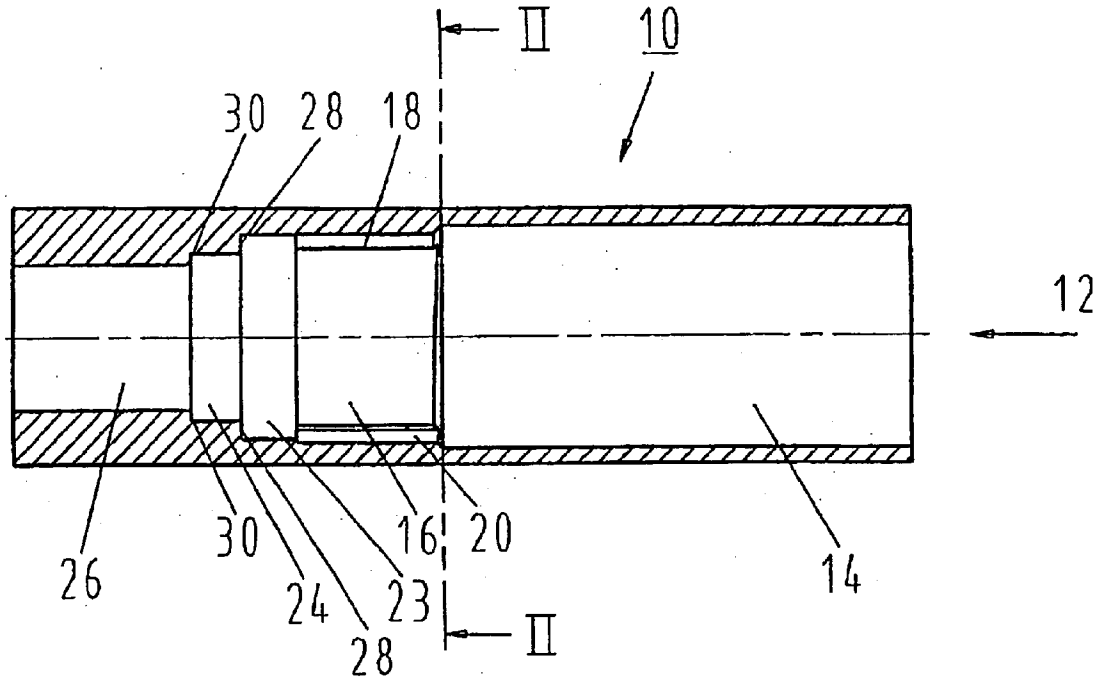

The cap sheath 10 shown in FIG. 1 has an open end 12 and a closed end (not shown). Beginning at the open end 12, the cap sheath has a first portion 14 with an internal diameter $d_1$, a second portion with three wedge-shaped surfaces rising radially in the circumferential direction, only two of which, namely 18 and 20, are visible, a third portion 23 with an internal diameter $d_2$, where $d_2<d_1$, a fourth portion 24 with an internal diameter $d_3$, where $d_3<d_2$, and a fifth portion 26 with an internal diameter $d_4$, where $d_4<d_3$. This creates inwardly projecting shoulders 28 and 30. Shoulder 30 serves as a stop face for a clamping ring (not shown).

Figure 2:
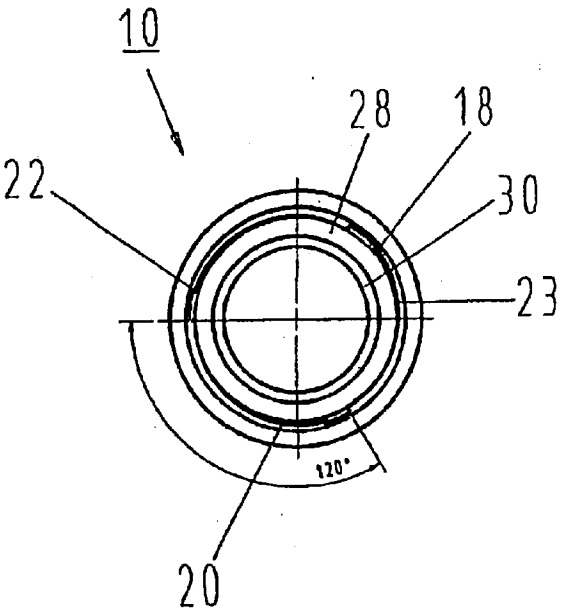
FIG. 2 shows a section view along the line II—II in FIG. 1.

As FIG. 2 shows, the wedge-shaped surfaces 18, 20 and 22 each extend through 120°.

Figure 3:
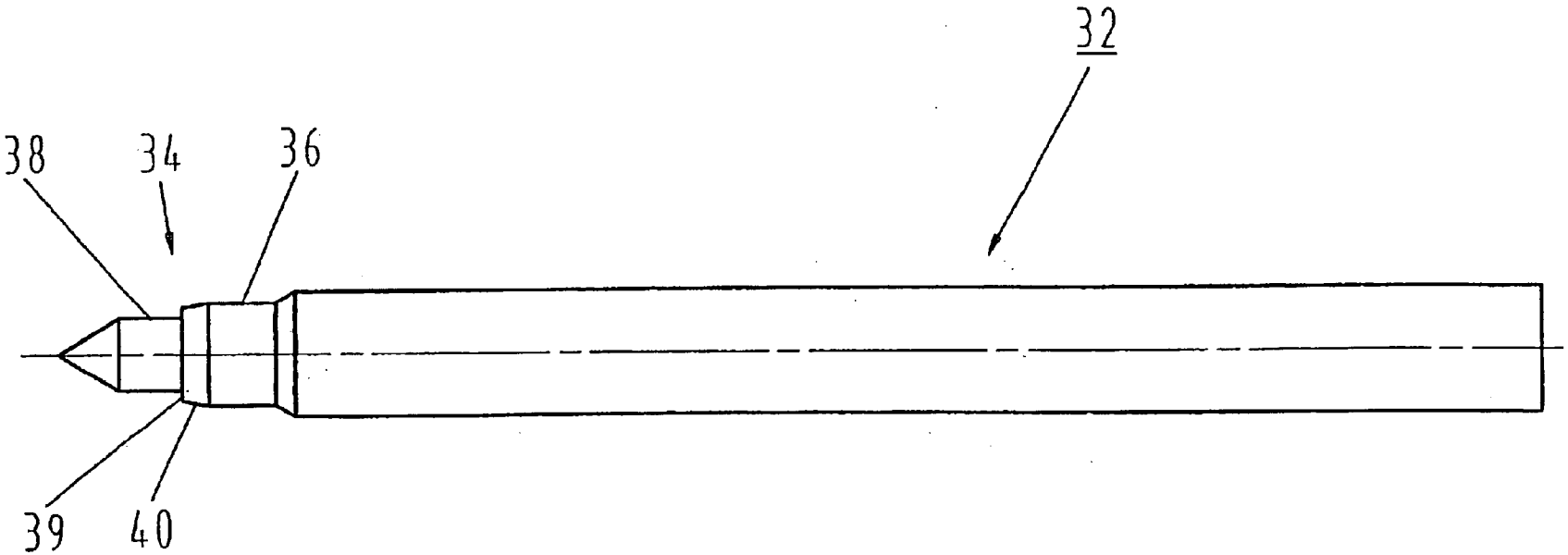
FIG. 3 shows a view of the side wall of a housing for a writing implement.

The housing 32 of a writing implement shown in FIG. 3, e.g. a fountain pen, has a housing tip 34 with two cylindrical portions 36 and 38 with different external diameters, which are connected to one another via a frustoconical portion 40 and the shoulder 39.

Figure 4:
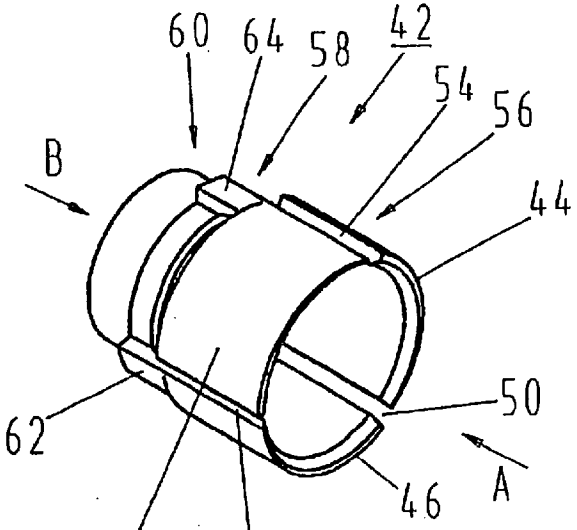
FIG. 4 shows a perspective view of a clamping ring for the cap.

FIG. 4 shows a perspective view of a clamping ring 42. It can be clearly seen that, in its longitudinal direction, the clamping ring 42 has wedge-shaped surfaces 44, 46 and 48 on the outer peripheral surface 3 rising radially over a portion in the circumferential direction, which are shaped in accordance with the wedge-shaped surfaces 18, 20 and 22. Between the wedge-shaped surfaces 44, 46 and 48 in each case, there is a gap 50, 52 or 54.

The clamping ring 42 can be subdivided into three portions 56, 58 and 60. The wedge-shaped surfaces 44, 46, 48 are disposed in portion 56. Three shoulders 62, 64 and 66 (see also FIG. 6) extending in the circumferential direction merely over a partial portion are provided in portion 58. The third portion 60 has a constant external diameter, which is less than the effective external diameter of portions 56 and 58.

Figure 5:
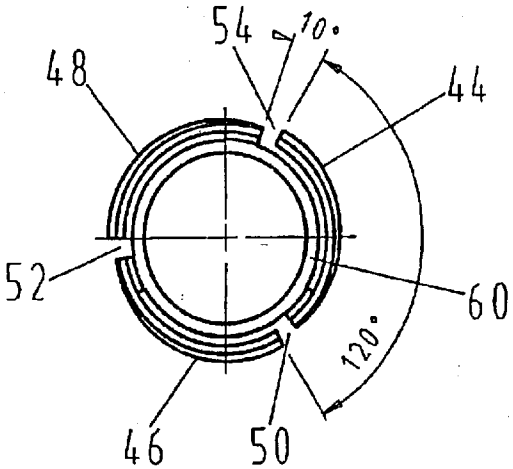
FIG. 5 shows a view of the clamping ring in the direction of arrow A in FIG. 4.

FIG. 5 shows a view of the clamping ring 42 in the direction of the arrow A. Each gap 50, 52 and 54 extends over an angular range of 10°.

Figure 6:
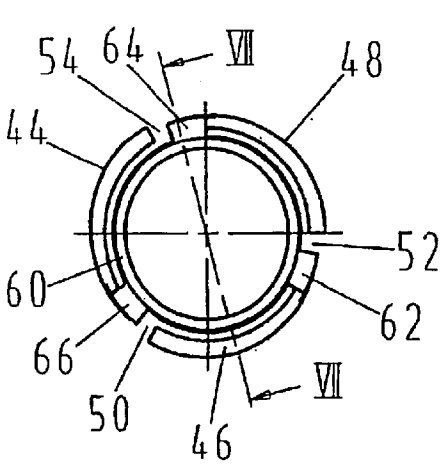
FIG. 6 shows a view of the clamping ring in the direction of arrow B in FIG. 4.
Figure 7:
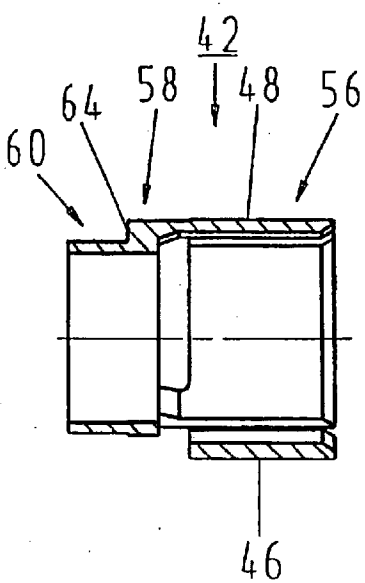
FIG. 7 shows a section view along the line VII—VII in FIG. 6.

FIG. 7 shows a section view along the line VII—VII of FIG. 6.

Figure 8:
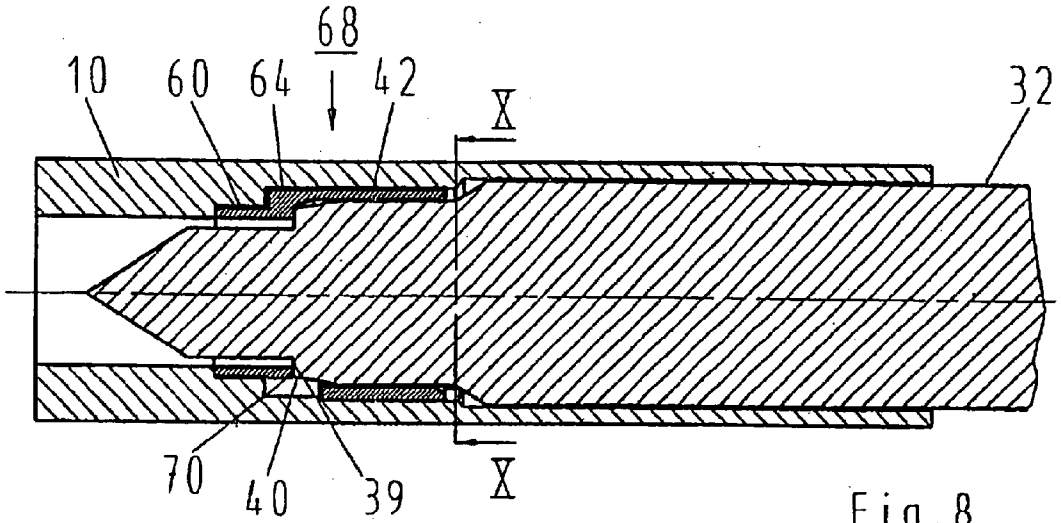
FIG. 8 shows a longitudinal section view of the housing of FIG. 3 with the cap attached.

FIG. 8 shows a longitudinal section view of the housing 32 of FIG. 3 with the cap 68 attached. The section corresponds to the section of FIG. 7. The cap 68 comprises the cap sheath 10 and the clamping ring 42, which is separate from the cap sheath. The clamping ring 42 is in friction fit with the housing 32. In addition, it can be seen that the shoulder 39 of the housing 32 abuts a shoulder 70 on the inside of the clamping ring 42. The clamping ring 42, for its part, has a portion 60 which abuts the shoulder 30 (see FIG. 1) of the cap sheath 10.

Figure 9:
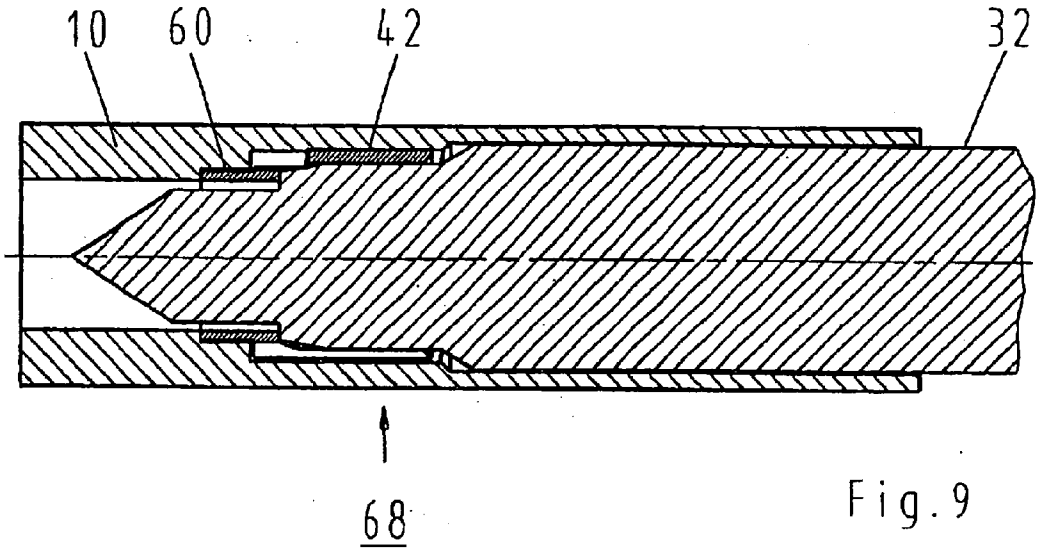
FIG. 9 shows a further longitudinal section view of the housing of FIG. 3 with the cap attached.

FIG. 9 shows a further longitudinal section view of the housing 32 of FIG. 3 with the cap 68 attached. Whereas the section shown in FIG. 8 runs through the shoulder 64, this section passes through one of the gaps 50, 52 and 54.

Figure 10:
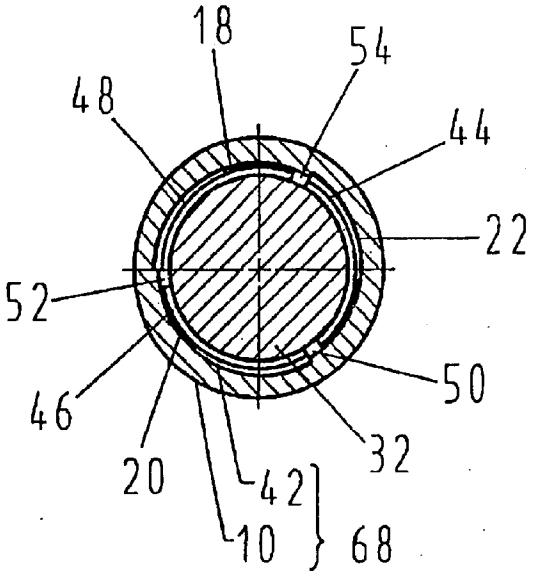
FIG. 10 shows a section view along the line X—X in FIG. 8.

FIG. 10 shows a section view along the line X—X of FIG. 8. The three wedge-shaped surfaces 18, 20 and 22 of the clamping ring 42 and the corresponding wedge-shaped surfaces 44, 46 and 48 of the cap sheath 10 can be seen clearly. When the clamping ring 42 is twisted relative to the cap sheath 10, its internal diameter is reduced accordingly. This leads to the cap 68 being clamped and thus also being firmly seated axially on the housing 32. The twisting imparted to the clamping ring 42 is caused by the friction fit with the housing 32. The cap 68 can be placed on in the usual fashion and locked in place with only a slight twist (<120°).

The features of the invention disclosed in the above description and in the claims can be essential, both alone and in any combination, for carrying out the invention in its various embodiments.

What is claimed is:

1. A cap for a writing, drawing or painting implement comprising;

a cap sheath having an inner peripheral surface;

a clamping ring disposed separately in the can sheath and having;

at least one wedge-shaped surface that rises radially in a circumferential direction disposed on the outer peripheral surface of the clamping ring; and a corresponding number of respective matching wedge-shaped surfaces disposed on the inner peripheral surface of the cap sheath, wherein the inner peripheral surface of the clamping ring is designed such that, by placing the cap on the housing, a friction fit or positive fit results between the clamping ring and the housing, and wherein the inner peripheral surface of the cap sheath and the outer peripheral surface of the clamping ring are designed such that, by placing the cap on the housing and then executing a relative axial twist between the can and the housing, a friction fit results between the cap sheath and the clamping ring, resulting in a firm axial fit between the cap and the housing.

2. The cap as claimed in claim 1, wherein slopes of the wedge-shaped surfaces and the matching wedge shaped surfaces facing each other are identical after the clamping ring has been inserted into the cap sheath.

3. The cap as claimed in claim 1, wherein the cap is designed such that it creates a seal when placed on the housing.

4. A cap for a writing, drawing or painting implement, the cap comprising:

a cap sheath having an inner peripheral surface with at least one cap surface portion that varies radially in a circumferential direction;

a clamping ring disposed generally concentrically within the cap sheath, the clamping ring having an inner peripheral surface and an outer peripheral surface, the outer peripheral surface having at least one ring surface portion that varies radially in a circumferential direction and that can at least partially overlie the at least one cap surface portion, wherein the cap sheath and the clamping ring can be twisted relative to one another between a locked position in which the inner peripheral surface of the clamping ring creates a firm axial fit between the cap and a housing of a writing, drawing or painting implement, and an unlocked position.

5. The cap as claimed in claim 4, wherein the inner peripheral surface of the clamping ring creates a positive friction fit between the clamping ring and a housing of a writing, drawing, or painting implement when in the locked position.

6. The cap as claimed in claim 4, wherein the at least one cap surface portion and the at least one ring surface portion create a positive friction fit therebetween when in the locked position.

7. The cap as claimed in claim 4, wherein the at least one ring surface portion further includes a plurality of wedge-shaped surfaces disposed circumferentially around the outer peripheral surface of the clamping ring, each rising radially in a circumferential direction, and wherein the at least one cap surface portion further includes a corresponding number of matching wedge-shaped surfaces disposed circumferentially around the inner peripheral surface of the cap sheath, each rising radially in a circumferential direction.

8. The cap as claimed in claim 7, wherein each of the wedge-shaped surfaces and its respective matching wedge-shaped surface has an identical slope.

9. The cap as claimed in claim 4, wherein the firm axial fit creates a seal between the clamping ring and both the housing and the cap sheath in the locked position.

* * * * *

UNITED STATES PATENT AND TRADEMARK OFFICE

CERTIFICATE OF CORRECTION

PATENT NO. : 6,910,825 B2
APPLICATION NO. : 10/489690
DATED : June 28, 2005
INVENTOR(S) : Jürgen Böckmann It is certified that error appears in the above-identified patent and that said Letters Patent is hereby corrected as shown below:

In the Specification:

Column 3, line 32, please insert after "having" -- outer and inner peripheral surfaces;--.

Column 3, line 48, "can" should be -- cap --.

Signed and Sealed this

Twenty-seventh Day of February, 2007

JON W. DUDAS
*Director of the United States Patent and Trademark Office*